US010431061B2

(12) United States Patent
Tovey et al.

(10) Patent No.: US 10,431,061 B2
(45) Date of Patent: Oct. 1, 2019

(54) VIRTUAL REPRESENTATION OF ACTIVITY WITHIN AN ENVIRONMENT

(71) Applicant: Walmart Apollo, LLC, Bentonville, AR (US)

(72) Inventors: David Tovey, Rogers, AR (US); Todd D. Mattingly, Bentonville, AR (US); Donald R. High, Noel, MO (US); Tim W. Webb, Rogers, AR (US); Eugene P. Sunday, Glen Ellyn, IL (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 15/826,476

(22) Filed: Nov. 29, 2017

(65) Prior Publication Data

US 2018/0151040 A1 May 31, 2018

Related U.S. Application Data

(60) Provisional application No. 62/427,396, filed on Nov. 29, 2016.

(51) Int. Cl.
*G08B 13/196* (2006.01)
*G08B 13/16* (2006.01)

(52) U.S. Cl.
CPC ... *G08B 13/19682* (2013.01); *G08B 13/1672* (2013.01); *G08B 13/19684* (2013.01)

(58) Field of Classification Search
None
See application file for complete search history.

(56) References Cited

U.S. PATENT DOCUMENTS 7,047,092 B2 5/2006 Wimsatt
7,680,694 B2 3/2010 Glazer
(Continued)

FOREIGN PATENT DOCUMENTS

WO 2006126205 11/2006
WO 2016120634 8/2016

OTHER PUBLICATIONS

PCT; App. No. PCT/US2017/063582; International Search Report and Written opinion dated Feb. 6, 2018.

*Primary Examiner* — Chico A Foxx
(74) *Attorney, Agent, or Firm* — Fitch, Even, Tabin & Flannery LLP

(57) ABSTRACT

In some embodiments, apparatuses and methods are provided herein useful to presenting a virtual representation of a user's environment based on activity in the user's environment. In some embodiments, a system comprises one or more sensors, wherein the one or more sensors are located about the user's environment and configured to detect the activity within the user's environment and transmit, to a control circuit, indications of the activity, the control circuit configured to receive, from the one or more sensors, the indications of the activity within the user's environment, generate the virtual representation of the user's environment, and render, based on the indications of the activity, the virtual representation of the user's environment to include representations of the activity within the user's environment, and a display device, the display device configured to present the virtual representation of the user's environment including the representations of the activity within the user's environment.

20 Claims, 3 Drawing Sheets

(56) References Cited

U.S. PATENT DOCUMENTS

| | | | | |
|---|---|---|---|---|
| 8,694,553 | B2 | 4/2014 | Shuster | |
| 9,295,144 | B2 | 3/2016 | Bora | |
| 2003/0189429 | A1* | 10/2003 | Belenger | G01R 31/44 324/414 |
| 2008/0162261 | A1 | 7/2008 | Velazquez | |
| 2008/0252640 | A1 | 10/2008 | Williams | |
| 2009/0121860 | A1* | 5/2009 | Kimmel | A62C 99/00 340/506 |
| 2010/0231506 | A1 | 9/2010 | Pryor | |
| 2010/0312366 | A1* | 12/2010 | Madonna | H05B 37/0245 700/90 |
| 2012/0229634 | A1* | 9/2012 | Laett | G08B 21/043 348/143 |
| 2012/0284672 | A1 | 11/2012 | Madonna | |
| 2013/0162423 | A1 | 6/2013 | Rowe | |
| 2015/0301716 | A1 | 10/2015 | Madonna | |
| 2015/0332622 | A1 | 11/2015 | Liu | |
| 2016/0261425 | A1 | 9/2016 | Horton | |

* cited by examiner

VIRTUAL REPRESENTATION OF ACTIVITY WITHIN AN ENVIRONMENT

CROSS-REFERENCE TO RELATED APPLICATION

This application claims the benefit of U.S. Provisional Application No. 62/427,396, filed Nov. 29, 2016, which is incorporated by reference in its entirety herein.

TECHNICAL FIELD

This invention relates generally to home and office automation and, more particularly, to home and office monitoring.

BACKGROUND

Security systems exist that can alert users to problems occurring at or within the user's environment (e.g., the user's home, office, or other property). For example, these systems can alert the user if someone breaks into his or her home, if smoke or carbon monoxide is detected at his or her home, or if a garage door is left open. While these systems can provide peace of mind to the user, they may not provide a complete picture of the activity that is occurring within the user's home. For example, the system may only alert the user if unusual or unexpected activity is detected (e.g., motion is detected in the user's home when the alarm is set). Consequently, a need exists for systems, methods, and apparatuses that can provide a user with richer information about activity occurring within his or her environment.

BRIEF DESCRIPTION OF THE DRAWINGS

Disclosed herein are embodiments of systems, apparatuses, and methods pertaining to presenting a virtual representation of a user's environment based on activity in the user's environment. This description includes drawings, wherein.

Figure 1:
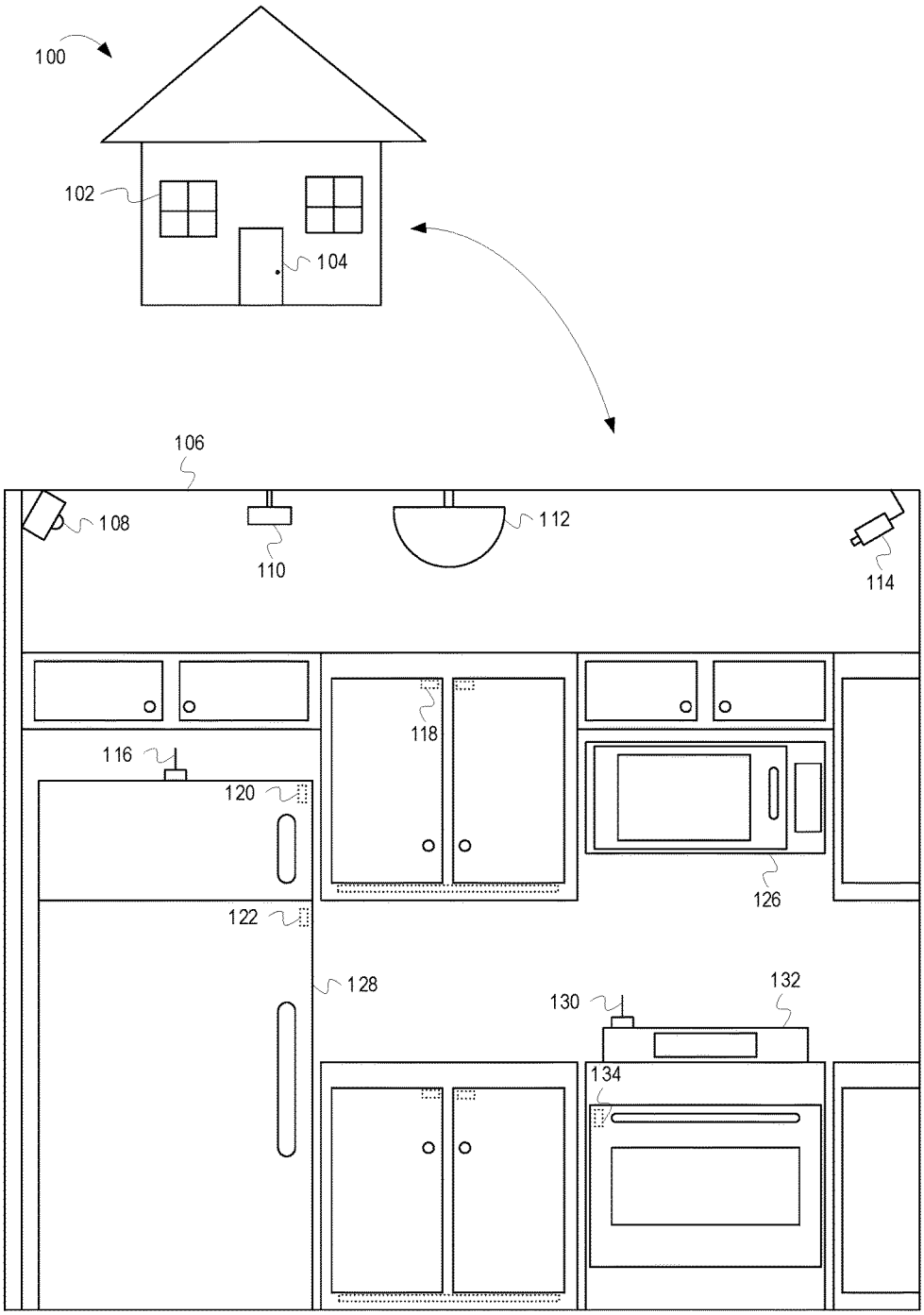
FIG. 1 depicts presentation of a virtual representation of a user's environment based on activity in the user's environment, according to some embodiments.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to various embodiments, systems, apparatuses, and methods are provided herein useful to presenting a virtual representation of a user's environment based on activity in the user's environment. In some embodiments, a system comprises one or more sensors, wherein the one or more sensors are located about the user's environment and configured to detect the activity within the user's environment and transmit, to a control circuit, indications of the activity within the user's environment, the control circuit configured to receive, from the one or more sensors, the indications of the activity within the user's environment, generate the virtual representation of the user's environment, and render, based on the indications of the activity within the user's environment, the virtual representation of the user's environment to include representations of the activity within the user's environment, and a display device, the display device configured to present the virtual representation of the user's environment including the representations of the activity within the user's environment.

As previously discussed, while current monitoring systems are capable of alerting users of unusual or unexpected activity on his or her property, they do not provide detailed information regarding activity that is occurring, or has occurred, within the user's property. Some embodiments of the methods, systems, and apparatuses described herein provide a user with detailed information regarding activity that is occurring, or has occurred, within his or her environment (e.g., in and around a user's home, office, or other property). In some embodiments, a system includes a variety of sensors which detect activity within the user's environment. The system generates a virtual representation of the user's environment and renders the virtual representation of the user's environment to include a representation of the activity. The user can view or review this virtual representation to understand in detail the activity that is occurring, or has occurred, within his or her environment. Additionally, in some embodiments, the user can create or modify programs via the system. The discussion of FIG. 1 provides background information about such a system.

FIG. 1 depicts presentation of a virtual representation of a user's environment based on activity in the user's environment, according to some embodiments. As depicted in FIG. 1, the user's environment is his or her house. Accordingly, the virtual representation of the user's environment includes a virtual representation of his or her house 100. As shown in FIG. 1, the user has selected to view a virtual representation of his or her kitchen 106. Consequently, the virtual representation of the user's kitchen 106 is presented alongside the virtual representation of his or her house 100.

In addition to presenting the virtual representation of the user's house 100 and kitchen 106, the system depicts virtual representations of activity within the user's house 100 and/or kitchen 106. The user's house includes a number of sensors which monitor activity in and around the house. For example, the user's kitchen can include the sensors depicted in the virtual representation of his or her kitchen 106. The virtual representation of the user's kitchen 106 includes a motion sensor 108, a noise sensor 110, and an image sensor 114 (e.g., a camera or video camera, or a light sensor), as well as a number of sensors associated with appliances and/or fixtures within the user's kitchen (e.g., a freezer door sensor 120 and a refrigerator door sensor 122 on the refrigerator 128, an electrical usage sensor on the light 112, a cabinet door sensor 118, an oven door sensor 134 on the oven 132, etc.). It should be noted that while FIG. 1 depicts virtual representations of the sensors in the virtual representation of the user's kitchen 106, this is not required. Additionally, the appliances can include sensors that monitor utility usage (e.g., gas, water, electric, etc.) and operating parameters. For example, the microwave 126 can include a usage sensor that detects when the microwave 126 is in use. Further, the appliances and/or sensors can include transmitters that transmit indications of activity (e.g., refrigerator transmitter 116 and oven transmitter 130). The user's house can also include sensors on the exterior portion, such as on the windows 102, the doors 104, and areas around the house (e.g., in the yard).

The virtual representation of user's environment can be prepared based on an initial scan, an input of equipment (e.g., appliances and other devices), dimensions of the user's environment, drawings of the user's environment, etc. In one embodiment, the user can perform a scan (e.g., a three hundred sixty degree scan) of his or her environment (i.e., in the example depicted in FIG. 1, his or her kitchen 106). The scan is then used to form a point cloud, from which the virtual representation of the user's environment can be generated. In such embodiments, the user may be able to perform this scan via an application running on his or her mobile device. In addition to generating the virtual representation of the user's environment based on the scan, in some embodiments, users can also specify objects and/or devices within his or her environment. For example, the user may be able to enter model numbers of appliances, sensors, etc. This information can allow the system to better create the virtual representation of the user's environment and better track and/or estimate usage and activity.

As activity occurs, the virtual representation of the user's environment is rendered (i.e., modified) to indicate the activity. That is, after, or while, receiving the indications of the activity, the system renders the virtual representation of the user's environment (i.e., the virtual representation of the user's house 100 and kitchen 106 in the example depicted in FIG. 1) to include virtual representations of the activity. For example, when a light in the user's kitchen represented by the virtual representation of the light 112 is turned on, the virtual representation of the light 112 can be rendered to indicate that the light is on. This rendering can be lifelike (i.e., the virtual representation of the light 112 appears to be illuminated) or indicated by pictorial representations (e.g., an icon appears on or near the virtual representation of the light 112 indicating that the light is on). Similarly, other virtual representations of other activity within the house can be rendered, such as doors opening, appliances opening or operating, utilities being used, windows opening, objects or animals or people moving within the house, etc.

Additionally, in some embodiments, the virtual representation of the user's environment can be rendered to depict remaining portion or expected remaining useful life of consumable goods. That is, the system can track the remaining portion or expected remaining useful life of consumable goods via weight measurements or usage. For example, the system can determine the expected remaining useful life of a connected device (e.g., a light bulb) by tracking usage of the connected device. The system could then render the virtual representation to indicate the remaining useful life (e.g., the representation of the light bulb gets dimmer the more it is used). As another example, the system could track the remaining portion of a food item (e.g., pasta) via a weight sensor in the cabinet. The system could then render the virtual representation of the user's environment to depict how much of the food item remained (e.g., via an image, a meter, a counter, etc.). In some embodiments, the system can also automatically reorder the consumable good when it is running low or the end of the useful life is being reached.

In some embodiments, the virtual representation of the user's environment is, or includes, a user interface through which the user can interact with the virtual representation of his or her environment and/or his or her environment. The user can interact with the system to modify a program (e.g., make changes to a lighting program based on viewing a virtual representation of the lighting program), set alerts (e.g., an alert is sent if the television is turned on after a certain time), set limits (e.g., a maximum volume for a stereo), etc. In some embodiments, the user can navigate the virtual representation of his or her environment via the user interface. For example, the user can select a room to view, or navigate through the virtual representation of his or her house 100 similarly to as if he or she were walking through his or her house. Additionally, in some embodiments, the user can navigate the virtual representations temporally via the user interface.

In addition to allowing the user to modify a program, in some embodiments, the system can suggest modifications to the programs. For example, the system can analyze the activity within the user's environment and develop suggestions for programs. These suggestions can be directed toward reducing utility usage, reducing congestion in the environment, increasing safety, etc. As one example, if a sensor for the light 112 indicates that the light 112 is illuminated but the motion sensor 108 does not detect any activity in the kitchen, the system could make a recommendation to turn the light 112 off. In some embodiments, the user could accept this recommendation and this recommendation could become a rule (e.g., to turn the light 112 off if the motion sensor 108 does not detect activity for five minutes). As a second example, the system could modify conditions that trigger alarms. For example, during a windy day, sensors outside of the house 100 may detect movement of tree branches, triggering an alarm. The system could suggest that the sensitivity of the outdoor sensors be decreased for windy days to prevent false alarms.

In some embodiments, the system can react to the presence of unexpected persons near the house 100. For example, if the sensors detect that a person is approaching the house 100 from the backyard and no one is home, the system can activate one or more devices within the home to provide the appearance that people are present in the house 100. As one example, the system may turn on the light 112 and/or a television when unexpected persons are near the house. In some embodiments, the system can playback a previously recorded event. For example, can cause devices in the house 100 to activate that were activated the last time there were a number of guests in the house 100, simulating a party or other event.

Additionally, in some embodiments, the system can use past and current virtual representations of the user's environment to detect events within the user's environment. In such embodiments, the system can utilize the camera 114 to capture an image of the user's kitchen 106. This can be done automatically, or on demand based on user input. The system then generates a virtual representation of the user's environment from the newly captured image. After generating the virtual representation of the user's environment, the system compares the virtual representation based on the captured image with a previously stored virtual representation. This comparison allows the system to determine if an event has occurred to which the user should be alerted (e.g., a broken window, a flood, etc.). In some embodiments, the system utilizes multiple cameras 114 and can generate a three-dimensional model of the user's environment. In such embodiments, the images captured from the multiple cameras can be used to automatically generate and/or update the virtual representation of the user's environment. For example, if the user purchases new furniture, the system can automatically update the virtual representation of the user's environment based on the captured images.

Figure 2:
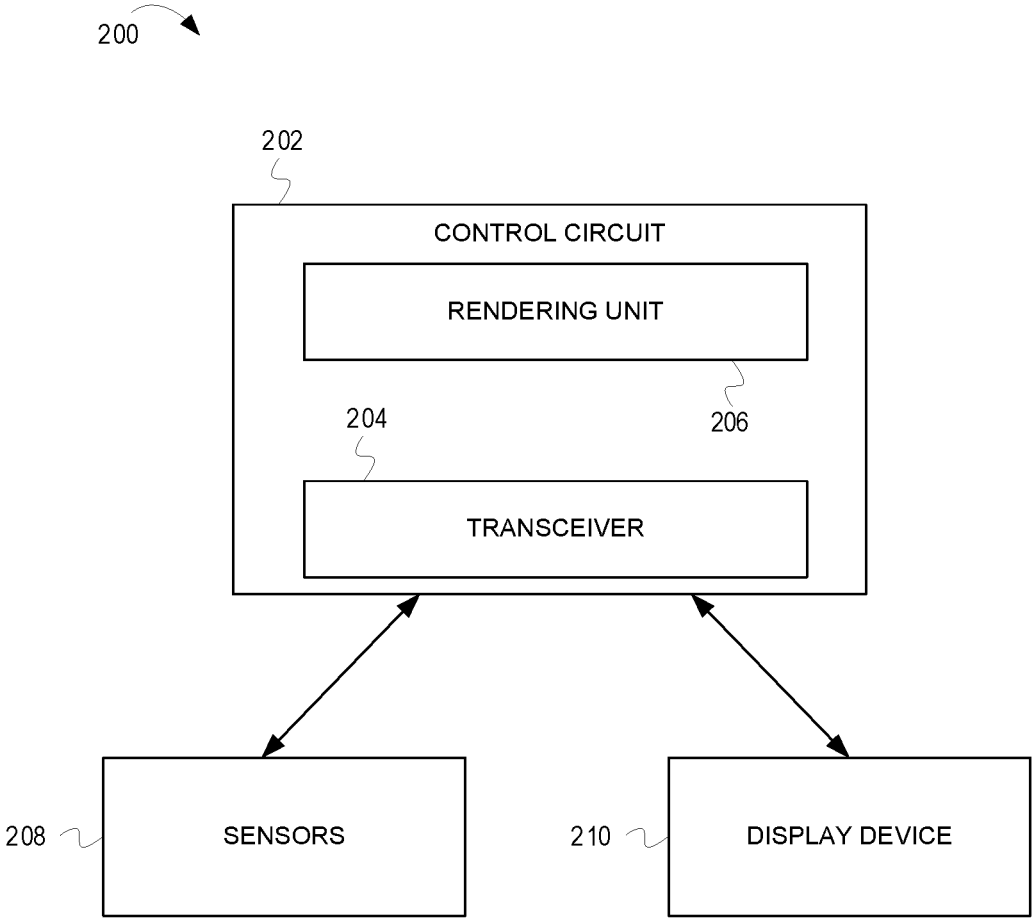
FIG. 2 is a block diagram of a system 200 for presenting a virtual representation of a user's environment based on activity in the user's environment, according to some embodiments.

While the discussion of FIG. 1 provides background regarding a system for generating a virtual representation of a user's environment based on activity within the user's environment, the discussion of FIG. 2 describes such a system in more detail.

FIG. 2 is a block diagram of a system 200 for presenting a virtual representation of a user's environment based on activity in the user's environment, according to some embodiments. The system 200 includes a control circuit 202, sensors 208, and a display device 210. The control circuit 202 can comprise a fixed-purpose hard-wired hardware platform (including but not limited to an application-specific integrated circuit (ASIC) (which is an integrated circuit that is customized by design for a particular use, rather than intended for general-purpose use), a field-programmable gate array (FPGA), and the like) or can comprise a partially or wholly-programmable hardware platform (including but not limited to microcontrollers, microprocessors, and the like). These architectural options for such structures are well known and understood in the art and require no further description here. The control circuit 202 is configured (for example, by using corresponding programming as will be well understood by those skilled in the art) to carry out one or more of the steps, actions, and/or functions described herein.

By one optional approach the control circuit 202 operably couples to a memory. The memory may be integral to the control circuit 202 or can be physically discrete (in whole or in part) from the control circuit 202 as desired. This memory can also be local with respect to the control circuit 202 (where, for example, both share a common circuit board, chassis, power supply, and/or housing) or can be partially or wholly remote with respect to the control circuit 202 (where, for example, the memory is physically located in another facility, metropolitan area, or even country as compared to the control circuit 202).

This memory can serve, for example, to non-transitorily store the computer instructions that, when executed by the control circuit 202, cause the control circuit 202 to behave as described herein. As used herein, this reference to "non-transitorily" will be understood to refer to a non-ephemeral state for the stored contents (and hence excludes when the stored contents merely constitute signals or waves) rather than volatility of the storage media itself and hence includes both non-volatile memory (such as read-only memory (ROM) as well as volatile memory (such as an erasable programmable read-only memory (EPROM).

The sensors 208 can be located about and around the user's environment (e.g., in a user's home or office, or near a user's home or office). The sensors 208 can be any type of sensor suitable for detecting activity within the user's environment, such as image sensors, motion sensors, light sensors, sound sensors, water usage sensors, energy usage sensors, proximity sensors, door closure sensors, etc. The sensors 208 detect activity within the user's environment and transmit indications of the activity to the control circuit 202.

The control circuit 202 receives the indications of the activity and generates a virtual representation of the user's environment. For example, in the example depicted in FIG. 2, the control circuit can include a rendering unit 206 and a transceiver 204. In such embodiments, the control circuit 202 receives the indications of the activity via the transceiver 204. The rendering unit 206 renders the virtual representation of the user's environment to include virtual representations of the activity within the user's environment. The rendering unit 206 can render the virtual representation of the user's environment and the activity in any suitable manner. For example, the virtual representations can be very lifelike (e.g., a virtual reality experience or a very high resolution two dimensional rendering) or simply a series of blocks that represent different areas or sensors. In some embodiments, the type of rendering can be dependent upon available resources, such as a type of the display device 210, a data transmission speed, a type of one or more of the sensors 208, etc.

After rendering the virtual representation of the user's environment and the activity, the control circuit 202 transmits, via the transceiver 204, the virtual representation of the user's environment including the representations of activity within the user's environment to the display device 210. The display device 210 presents the virtual representation of the user's environment including the representations of activity within the user's environment. The display device 210 can present the virtual representations in real, or substantially real, time, and/or after the activity has occurred (e.g., the user can view the virtual representations to understand the activity that occurred within his or her environment yesterday, last week, last month, etc.). The display device 210 can be any suitable type of device, such as a television, a computer, a mobile device, etc.

Figure 3:
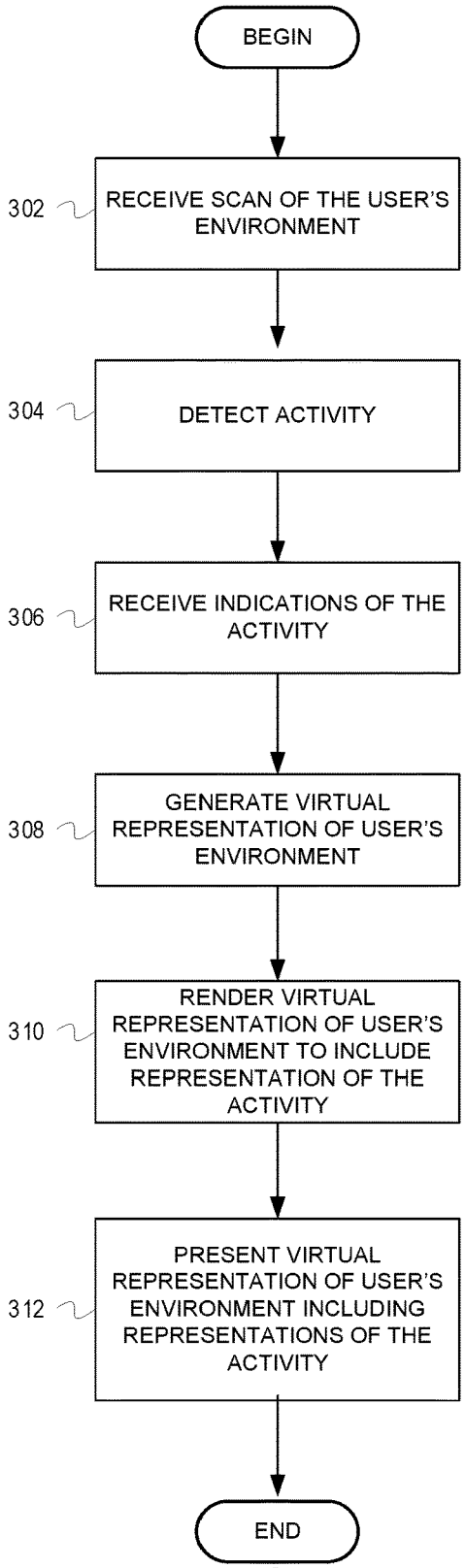
FIG. 3 is a flow chart depicting example operations for presenting a virtual representation of a user's environment based on activity in the user's environment, according to some embodiments.

While the discussion of FIG. 2 provides additional detail regarding a system for generating a virtual representation of a user's environment based on activity within the user's environment, the discussion of FIG. 3 provides example operations for generating a virtual representation of a user's environment based on activity within the user's environment.

FIG. 3 is a flow chart depicting example operations for presenting a virtual representation of a user's environment based on activity in the user's environment, according to some embodiments. The flow begins at block 302.

At block 302, a scan of the user's environment is received. For example, a control circuit can receive the scan of the user's environment. In one embodiment, the user can perform a scan (e.g., a three hundred sixty degree scan) of his or her environment. The scan is then used to form a point cloud, from which the virtual representation of the user's environment can be generated (e.g., a three dimensional representation). In such embodiments, the user may be able to perform this scan via an application running on his or her mobile device. In addition to generating the virtual representation of the user's environment based on the scan, in some embodiments, users can also specify objects and/or devices within his or her environment. For example, the user may be able to enter model numbers of appliances, sensors, etc. This information can allow the system to better create the virtual representation of the user's environment and better track and/or estimate usage and activity. The flow continues at block 304.

At block 304, activity is detected. For example, sensors located about a user's environment can detect activity within the user's environment. The activity can be movement within the user's environment, sounds within the user's environment, device usage within the user's environment, changes within the user's environment, etc. The sensors can be any type of sensors suitable for detecting activity. The flow continues at block 306.

At block 306, indications of the activity are received. For example, a control circuit can receive indications of the activity from the sensors. The indications of the activity are representative of the activity detected. Additionally, in some embodiments, the indications of the activity can include additional information, such as timestamps, date stamps, location tags, sensor identifiers, etc. The flow continues at block 308.

At block 308, a virtual representation of the user's environment is generated. For example, the control circuit generates the virtual representation of the user's environment. The virtual representation of the user's environment includes objects and devices within the user's environment. The virtual representation of the user's environment can be as lifelike or simple as desired. The virtual representation of the user's environment can be based on any suitable data, such as images of the user's environment, CAD data for the user's environment, etc. The flow continues at block 310.

At block 310, the virtual representation of the user's environment is rendered to include virtual representation of the activity within the user's environment. For example, the control circuit can render the virtual representation of the user's environment to include virtual representations of the activity within the user's environment. The virtual representations of the activity within the user's environment are based on the indications of the activity within the user's environment. The virtual representation of the user's environment can be rendered to include virtual representations of the activity by altering the virtual representation of the user's environment to depict the activity (e.g., by turning lights on or off, opening or closing doors, depicting people, animals or objects, indicating utility or appliance usage, etc.). The flow continues at block 312.

At block 312, the virtual representation of the user's environment including the virtual representations of the activity is presented. For example, a display device can present the virtual representation of the user's environment to include virtual representations of the activity within the user's environment. The display device can be any suitable display device and can present the virtual representation of the user's environment to include virtual representations of the activity within the user's environment remotely from, and/or locally to, the user's environment.

Those skilled in the art will recognize that a wide variety of other modifications, alterations, and combinations can also be made with respect to the above described embodiments without departing from the scope of the invention, and that such modifications, alterations, and combinations are to be viewed as being within the ambit of the inventive concept.

Generally speaking, pursuant to various embodiments, systems, apparatuses, and methods are provided herein useful to presenting a virtual representation of a user's environment based on activity in the user's environment. In some embodiments, a system comprises one or more sensors, wherein the one or more sensors are located about the user's environment and configured to detect the activity within the user's environment and transmit, to a control circuit, indications of the activity within the user's environment, the control circuit configured to receive, from the one or more sensors, the indications of the activity within the user's environment, generate the virtual representation of the user's environment, and render, based on the indications of the activity within the user's environment, the virtual representation of the user's environment to include representations of the activity within the user's environment, and a display device, the display device configured to present the virtual representation of the user's environment including the representations of the activity within the user's environment.

In some embodiments, an apparatus and a corresponding method performed by the apparatus, comprises monitoring, via one or more sensors located about the user's environment, the activity within the user's environment, receiving by a control circuit from the one or more sensors, indications of the activity within the user's environment, generating, by the control circuit, the virtual representations of the user's environment, rendering, based on the indications of the activity within the user's environment, the virtual representation of the user's environment to include representations of the activity within the user's environment, and presenting, via a display device, the virtual representation of the user's environment including the representations of the activity within the user's environment.

What is claimed is:

1. A system for presenting a virtual representation of a user's environment based on activity in the user's environment, the system comprising:

one or more sensors, wherein the one or more sensors are located about the user's environment and configured to:
- detect the activity within the user's environment;
- detect, for multiple items within the user's environment, remaining useful lives; and
- transmit, to a control circuit, indications of the activity within the user's environment and the remaining useful lives;

the control circuit configured to:
- receive, from a mobile device associated with the user, a scan of the user's environment;
- receive, from the one or more sensors, the indications of the activity within the user's environment and the remaining useful lives;
- generate, based on the scan of the user's environment, the virtual representation of the user's environment;
- render, based on the indications of the activity within the user's environment, the virtual representation of the user's environment to include representations of the activity within the user's environment; and
- reorder, automatically for the user based on the remaining useful lives for the multiple items within the user's environment, those of the multiple items having a remaining useful life below a threshold; and a display device, the display device configured to present, based on the rendering of the virtual representation of the user's environment, the virtual representation of the user's environment including the representations of the activity within the user's environment.

2. The system of claim 1, wherein the one or more sensors include one or more of image sensors, motion sensors, light sensors, sound sensors, water usage sensors, energy usage sensors, proximity sensors, and door closure sensors.

3. The system of claim 1, wherein the control circuit is further configured to:

generate a user interface, wherein the user interface allows the user to interact with the system; and receive, via the user interface, user input.

4. The system of claim 3, wherein the user input is to set an alert based on a trigger condition, and wherein the control circuit is further configured to:

determine, based on the indications of the activity within the user's environment, that the trigger condition has occurred;

generate, based on the occurrence of the trigger condition, an alert; and transmit, to the user, the alert.

5. The system of claim 3, wherein the user input is to set a limit for one or more devices within the user's environment, wherein the control circuit is further configured to:

transmit, to the one or more devices within the user's environment, an indication of the limit, wherein the indication of the limit causes the one or more devices within the user's environment to adhere to the limit.

6. The system of claim 5, wherein the one or more devices are one or more of appliances and utilities.

7. The system of claim 3, wherein the user input is to modify a program for one or more devices in the user's environment, and wherein the control circuit is further configured to modify the program for the one or more devices in the user's environment based on the user input.

8. The system of claim 1, wherein the control circuit is further configured to:

update, based on images captured by cameras associated with the system, the virtual representation of the user's environment.

9. The system of claim 1, wherein one or more devices in the user's environment operate based on a program, and wherein the control circuit is further configured to:

analyze the indications of activity within the user's environment; and develop, based on the analysis of the indications of activity within the user's environment, suggestions for program modifications.

10. The system of claim 1, wherein the control circuit renders the virtual representation of the user's environment to include representations of the activity within the user's environment in real time.

11. A method for presenting a virtual representation of a user's environment based on activity in the user's environment, the method comprising:

monitoring, via one or more sensors located about the user's environment, the activity within the user's environment;

monitoring, via the one or more sensors located about the user's environment, remaining useful lives for multiple items within the user's environment;

receiving, by a control circuit from a mobile device associated with the user, a scan of the user's environment;

receiving, by the control circuit from the one or more sensors, indications of the activity within the user's environment and the remaining useful lives for multiple items in the user's environment;

generating, by the control circuit based on the scan of the user's environment, the virtual representation of the user's environment;

rendering, based on the indications of the activity within the user's environment, the virtual representation of the user's environment to include representations of the activity within the user's environment;

reordering, automatically for the user based on the remaining useful lives for the multiple items within the user's environment, those of the multiple items having a remaining useful life below a threshold; and presenting, via a display device based on the rendering of the virtual representation of the user's environment, the virtual representation of the user's environment including the representations of the activity within the user's environment.

12. The method of claim 11, wherein the one or more sensors include one or more of image sensors, motion sensors, light sensors, sound sensors, water usage sensors, energy usage sensors, proximity sensors, and door closure sensors.

13. The method of claim 11, further comprising:

generating a user interface, wherein the user interface allows the user to interact with the system; and receiving, via the user interface, user input.

14. The method of claim 13, wherein the user input is to set an alert based on a trigger condition, the method further comprising:

determining, based on the indications of the activity within the user's environment, that the trigger condition has occurred;

generating, based on the occurrence of the trigger condition, an alert; and transmitting, to the user, the alert.

15. The method of claim 13, wherein the user input is to set a limit for one or more devices within the user's environment, the method further comprising:

transmitting, to the one or more devices within the user's environment, an indication of the limit, wherein the indication of the limit causes the one or more devices within the user's environment to adhere to the limit.

16. The method of claim 15, wherein the one or more devices are one or more of appliances and utilities.

17. The method of claim 13, wherein the user input is to modify a program for one or more devices in the user's environment, the method further comprising:

modifying the program for the one or more devices in the user's environment based on the user input.

18. The method of claim 11, wherein the display device is one or more of a television, a computer, and a mobile device.

19. The method of claim 11, wherein one or more devices in the user's environment operate based on a program, the method further comprising:

analyzing the indications of the activity within the user's environment; and developing, based on the analyzing the indications of the activity within the user's environment, suggestions for program modifications.

20. The method of claim 11, wherein the rendering the virtual representation of the user's environment to include representation of the activity within the user's environment occurs in real time.

* * * * *